US007461799B2

(12) United States Patent
Niemi et al.

(10) Patent No.: US 7,461,799 B2
(45) Date of Patent: Dec. 9, 2008

(54) METHOD FOR INDUSTRIAL PRODUCING OF HIGHLY DISPERSED POWDERS

(75) Inventors: Jouko Niemi, Pirkkala (FI); Jarkko Tamminen, Tampere (FI)

(73) Assignee: Micropulva Ltd Oy, Pirkkala (FI)

( * ) Notice: Subject to any disclaimer, the term of this patent is extended or adjusted under 35 U.S.C. 154(b) by 96 days.

(21) Appl. No.: 10/574,957

(22) PCT Filed: Oct. 10, 2003

(86) PCT No.: PCT/FI03/00750

§ 371 (c)(1),
(2), (4) Date: Apr. 7, 2006

(87) PCT Pub. No.: WO2005/035127

PCT Pub. Date: Apr. 21, 2005

(65) Prior Publication Data

US 2007/0075167 A1 Apr. 5, 2007

(51) Int. Cl.
*B02C 19/06* (2006.01)

(52) U.S. Cl. ..... 241/5; 241/29; 241/39; 241/80

(58) Field of Classification Search ..... 241/5, 241/39, 80, 97, 29
See application file for complete search history.

(56) References Cited

U.S. PATENT DOCUMENTS 3,482,786 A * 12/1969 Hogg ..... 241/52
3,877,647 A * 4/1975 Gorobets et al. ..... 241/39
4,034,919 A * 7/1977 Akunov et al. ..... 241/39
4,592,302 A * 6/1986 Motoyama et al. ..... 118/303
4,720,049 A 1/1988 Niemi
5,143,303 A 9/1992 Niemi

FOREIGN PATENT DOCUMENTS

| | | |
|---|---|---|
| RU | 2149062 | 5/2000 |
| WO | WO 8801906 | 3/1988 |
| WO | WO 9836840 | 8/1998 |

* cited by examiner

*Primary Examiner*—Mark Rosenbaum
(74) *Attorney, Agent, or Firm*—Stites & Harbison PLLC; Douglas E. Jackson

(57) ABSTRACT

This invention relates to industrial production of fine dispersed powders, where the material to be pulverized is mixed with high-pressure working into a gas-solids suspension, which through acceleration nozzles (8) is conveyed to the pulverizing chamber of counterjet pulverizer (9) for autogenous pulverization. The method is known in that the pulverized gas solids suspension is conveyed in the pulverizing circle at least to one intermediate tank (12), where the gas is removed from the blend and solids are collected into intermediate tank (12), which are returned together with new raw material for pulverization till in the equipment a wanted circulation load is achieved, whereafter the process continues so that from it as much ready product is removed as new material is added to it.

11 Claims, 2 Drawing Sheets

METHOD FOR INDUSTRIAL PRODUCING OF HIGHLY DISPERSED POWDERS

Figure 1:
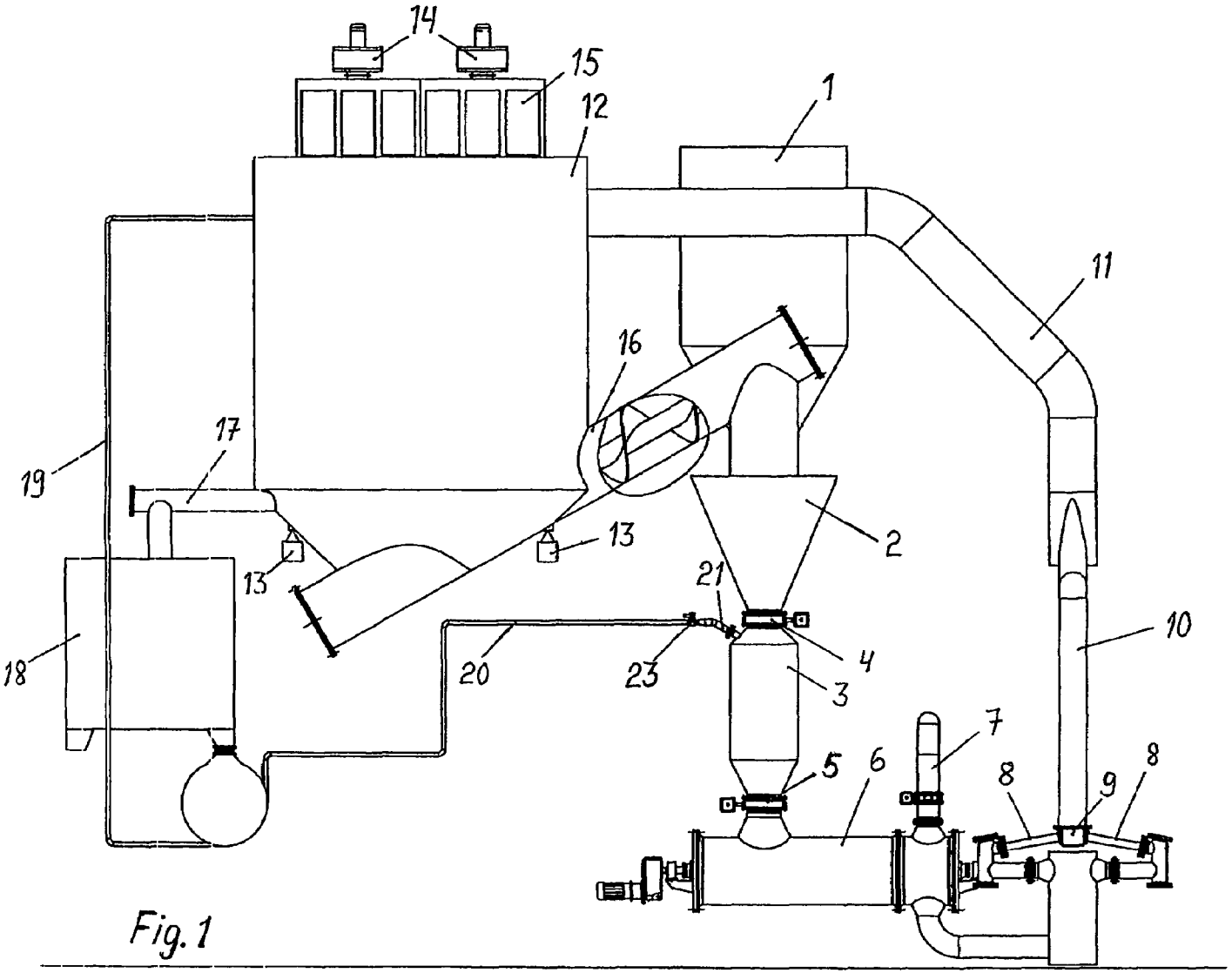

This invention relates to a method for industrial production of high dispersed powders, by means of which it possible to produce for the processing industry necessary powders and coating agents and pigments which are finer than before and which are most economical, effective and solid.

Currently, micronizing methods of different types based on the 1-phase principle are in general use, by means of which methods solid powders and coating agents and pigments necessary for the processing industry are produced. In devices based on the 1-phase principle as pulverizing energy high pressure energetic working gas, compressed air, steam or some shielding gas is used.

As essential part of the micronizing device based on the 1-phase technique there is often also a built-in pneumatic classifier often furnished with a mechanical rotor. Generally, processes working by 1-phase principle function so that the material to be pulverized is fed to the process in a stage, where in separate gas nozzles accelerated kinetic energy is developed into corpuscles/particles to be pulverized, for instance by means of mere 9 bar or even 16 bar working gas, resulting in that they become pulverized to some extent. Clearly the kinetic energy generated in the particles, regardless of high pressure and energetic working gas, remains quite small and the pulverizing effect poor. It is especially difficult to produce products by 1-phase technique, where especially corpuscles, the size of which is within the range 0.2-5 microns for instance of industrial minerals. Then the consumption/cost of energy increases quite strongly and the production capacity of the equipment drops.

The operation conditions of a functioning pulverizing method working by the 1-phase principle get worse, since while the size of the particles is getting smaller the classification of particles using a rotor-furnished pneumatic classifier becomes quite difficult, because as a mass the particles under 5 microns behave almost like gas.

Devices working by 1-phase flow are often so built that pulverizing and classification take place in the same place and are linked together also through the volume of gas. This is not good, since a small change in either partial process may have a harmful effect on the other part of the process. Restrictions of this type in present devices based on the 1-phase principle powerfully restrict the possibilities to produce for the industry necessary solid end products and to their average fineness 0.2-5.0 microns economically and effectively.

The intention of this invention is elimination of the above presented disadvantages, which is accomplished by the method of this invention.

Other characteristics of this invention are disclosed hereafter as well.

According to the method of this invention the material to be pulverized is fed by a double-valve feeder to a counterjet pulverizer. In the intermediate tank of the double-valve feeder feed pressure higher than the real pulverizing pressure is used. The flow of working gas of the counterjet pulverizer is cut off or choked for a short time, when the lower valve of the double-valve feeder is opened. This measure ensures effective travel of material with low bulk density to the balancing tank of the counterjet pulverizer, in the end part of which the wanted gas-solids suspension is generated from material and energetic working gas. Material pulverizing takes place, depending on the matter, by means of economically developed working gas of 1-8 bar pressure. The generated gas-solids suspension makes it possible to utilize the 2-phase flow effectively.

The kinetic energy contained in the gas-solids suspension can be used and utilized in different pulverizing chamber units effectively in a small space, where also small particles are in the sphere of influence of high-energy particles in a controllable way. This takes place using in the pulverizing chambers acceleration nozzles of different types as occasion demands. For instance, in one unit it is possible to use conventional acceleration nozzles in another unit acceleration nozzles furnished with gas outlet holes. Then the units produce as to their granulate distribution different kinds of products, in other words thus it is possible to focus the use of energy on the production of some particle sizes or to restrict the production of some particle sizes.

Products pulverized in separate pulverizing units can be kept separated or joined and stored in an intermediate tank built in one or several pulverizing spheres of influence. The function of intermediate storing is to control by means of mass-monitoring the volume of circulation load. In this case, producing autogenously ultra fine 0.2-5 micron particles requires in the pulverizing circle a great circulation load and it is wise to build the volume needed by the circulation load outside the normal pulverizing equipment.

The bulk density of material momentary stored in the intermediate tank but being in circulation rises, which facilitates its effective backfeed to the counterjet pulverizer.

From the intermediate tank or tanks removal of material is also started as end product after the wanted circulation load quantity is generated in the pulverizing circle. Since all material that is to be pulverized moves through the pulverizing chambers of the counterjet pulverizer the particles to be pulverized stay in the pulverizing process min. for 1 pulverizing circulation and max. for as long as chosen circulations, for instance 7 circulations. The intermediate tank or tanks are so dimensioned that the circulation load can be even quite big and have a weighing system, which is part of the process control. In the above case, for instance, the intermediate tank must have room for material as much as 7× feed quantity.

Of course the quantity of the removing end product is the same as the quantity of new material to be fed into the pulverizer. The use of an intermediate tank enables controllable circulation of the material and makes it also possible that important, especially of solid minerals with difficulty produced particles in the size of 0.2-5.0 microns can be effectively produced in greater quantity using by pulverizing a necessary amount of pulverizing circulations and as to their geometry different acceleration nozzles.

Material to be returned from the intermediate tank to the counterjet pulverizer is often, depending on the matter, very light as to its bulk density, which can be even under 100 $kg/m^3$. Therefore it is worse to compress the material in a separate pressing screw conveyor before feeding into the counterjet pulverizer. Increase of the bulk density improves the material handling significantly.

If the end product must be highly dispersed and in spite of the screw compression the bulk density of material circulating in closed circuit lessens it is possible to use in connection with the counterjet pulverizer two double-valve feeder. Then the gas consumption to be used can almost be halved in utilizing the removable gas for initial pressurization of the tank of the other feeder.

The material to be taken as end product from the intermediate tank can, if necessary, be handled by a separate mechanical classifier outside the pulverizing circle, the operating principle of which is not based on gas flows and the gas is not a factor controlling the operation. With such a classificating device largest particles can be controllably separated from the end product and returned together with the circulating load to the counterjet pulverizer. Coarse product separated by the classifier can be transported into the intermediate tank as a pneumatic transfer, and as transport air pressurized air releasable can be used releasable after initial pressurization, from the double-valve feeder of the intermediate tank.

Of uniform raw material, i.e. material advantageously pre-pulverized in a mechanical pulverizer, an end product of unchangeable quality can be easily produced. In this manner it is possible to put pulverizing according to this invention into practice so that the share of product of necessary granular class 0.2-5 Φm increases. During circulation also the coarser granular classes reduce. Therefore no reclassification is needed. In order to ensure uniform raw material a control unit can be connected to the equipment, into which unit the limit values of most important factors connected to the micronizing process are programmed, such as quantity of raw material per time unit, quantity of end product per time unit, quantity of working gas per time unit, and its pressure and temperature.

quantity of energy used for working gas pressurization quantity of circulation load gas per time unit Since the critical parts of the pulverizing unit retain their form for thousands of operation hours, by means of certain limit values a good quality product with unchangeable form can be produced. If a deviation occurs in the limit values, the process is interrupted and the failure corrected. This simple system facilitates the use of the process and the quality control of the end product.

Figure 2:
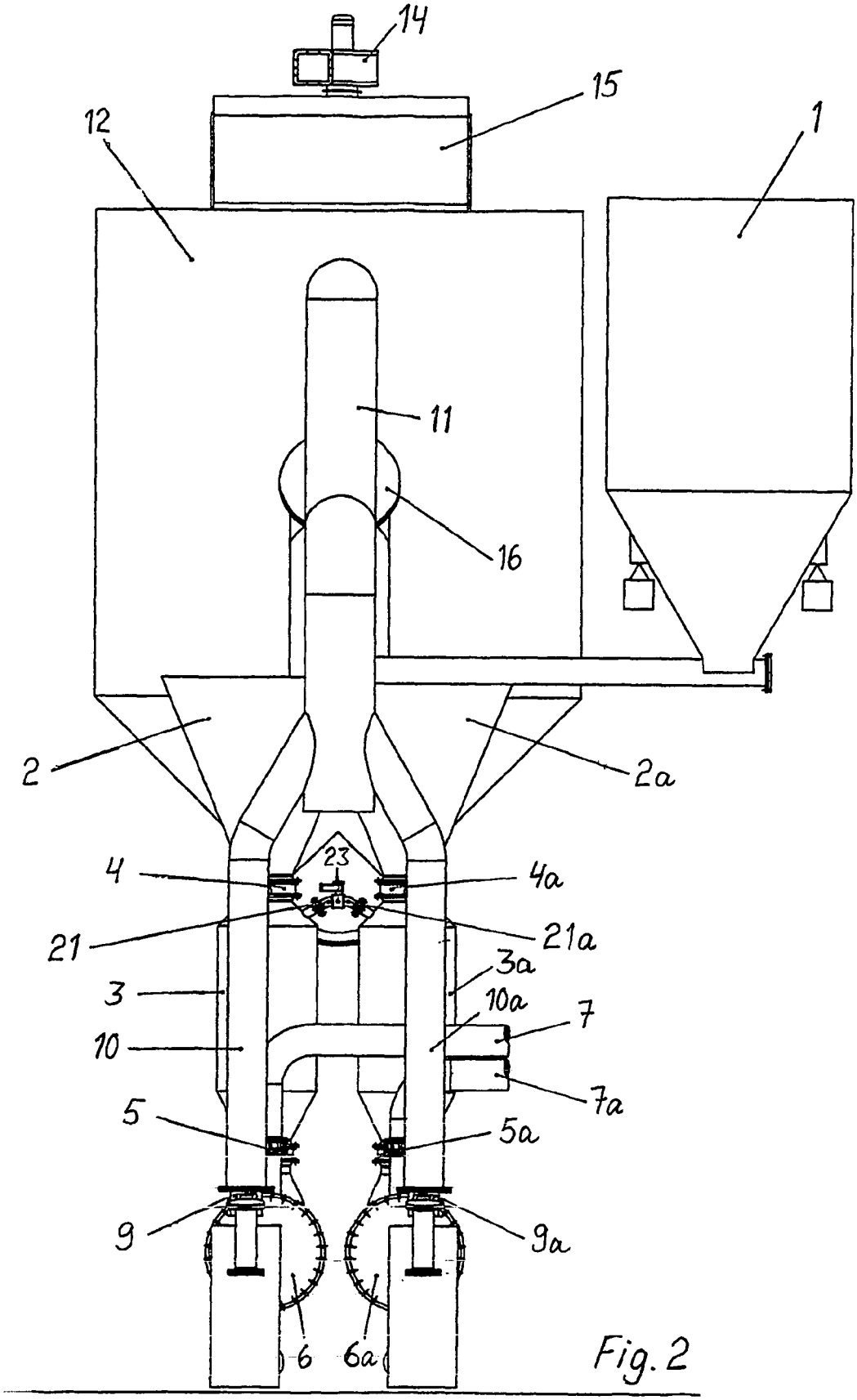

In the following the invention is disclosed with reference to the enclosed drawings, where FIG. 1 shows an example as a side view of an equipment used for utilization of the method according to the invention and FIG. 2 shows the equipment as per FIG. 1 from the right side.

Material to be pulverized or possibly pre-pulverized in a mechanical pulverizer according to the invention is fed from feed tank 1 to feed hopper 2 of double-valve feeder, from where it is let step-by-step to intermediate tank 3 of double-valve feeder, when the tank upper valve 4 has opened. After receiving the batch of material upper valve 4 is closed and the intermediate tank is pressurized, for instance to a pressure of 5 bar, whereafter lower valve 5 of double-valve feeder is opened and the pressurized batch of material is by means of excess pressure forced to balancing tank 6, into which feed of working gas from tube 7 is broken or choked for a while in order to facilitate the transfer of light material. Then lower valve 5 is closed again, after which the pressure of intermediate tank 3 is let to the level of environment pressure conveying the pressurized gas in it somewhere through tube 21. Then upper valve 4 is opened for a new batch of material from feed hopper 2. Material pulverized in balancing tank 6 is then mixed with working gas, for instance pressurized in 3.5 bar pressure, into gas-solids suspension. From balancing tank 6 the gas-solids suspension is accelerated by the effect of working gas pressure through acceleration nozzles 8 of counterjet pulverizer 9 to the pulverizing chamber, where the material particles are autogenously pulverized on colliding with high speed. Gas-solids suspension pulverized in counterjet pulverizer 9 is conveyed through tubes 10 and 11 to large-sized stock 12 furnished with weighing system 13 for control of the collected material quality. Namely, in intermediate depot such a quantity of solids must be collected that in the system there is a sufficient circulation load in order to achieve a wanted end product, which sufficient circulation load must be maintained all the time during pulverizing process. Air is removed from intermediate tank 12 by means of suitable nozzles 14, which prevent the access of small material particles to open air. Solids collected into intermediate tank 12 tighten a little, which improves the handling of them, when returned to for pulverizing together with new material. When aimed high dispersed product, the bulk density of which is low, the bulk density of material collected into intermediate tank 12 can still be raised by means of pressing screw conveyor 16. Circulation of solids through the pulverizing equipment together with new raw material fed from feed tank 1 continues till in the equipment the target load is reached. Then the process is continued so that from feed tank 1 as much new raw material is fed, which is pulverized together with solids circulated from stock 12, as ready-made material is removed from intermediate tank 12 through exhaust tube 17. This product can be used either as such or in some cases conveyed to mechanical classifier 18 outside the pulverizing circle, where the greatest particles are separated from the end product. This separated coarse product is returned to intermediate tank 12 along tube 19 for additional pulverizing. For return of the coarse product pressurized gas releasable from intermediate tank 3 of double-valve feeder can be used after initial pressurizing which gas is conveyed along tube 20 to collection pocket of classifier 18.

According to an advisable embodiment there are in the equipment side by side two counterjet pulverizers 9,9*a* with own feed devices 2,2*a*; 3,3*a*; 4,4*a*; 5,5*a*; 6,6*a*; 7,7*a*, which is an advantage, for instance when the pulp density of material to be pulverized is low. Then it is advisable that the one counterjet pulverizer 9 is furnished with conventional acceleration nozzles 8 and the other counterjet pulverizer 9*a* is furnished with acceleration nozzles furnished with gas outlet channels, whereby also the pulverizing chamber itself is shaped otherwise than presented in Finnish patent application 20020531. By means of this new type pulverizer the pulverizing conditions can most effectively be regulated so that the end product of a wanted granule class is easily achieved.

Then both the double-feed pulverizers can advantageously be synchronized so that when a material batch has been supplied the after-pressure left in tank 3 of one double-feed pulverizer can be made use of through tubes 21 and 21*a* as initial pressure of tank 3*a* of the other double feed pulverizer after receipt of a new material batch when valves 23 in tube 20 is kept closed. Then the gas consumption in connection with feeding gets almost halved.

The invention claimed is:

1. A method for industrial production of high dispersed powders, comprising the steps of:

mixing material to be pulverized with high pressure working gas into a gas-solids suspension, conveying of the gas-solids suspension through acceleration nozzles to a pulverizing chamber of a counterjet pulverizer for autogenic pulverizing, conveying the pulverized gas-solids suspension to an intermediate tank, said steps of mixing, conveying to a pulverizing chamber and conveying to an intermediate tank comprising a pulverizing cycle, removing the gas from the gas-solids suspension and collecting the solids in the intermediate tank, returning solids from the intermediate tank to be pulverized together with new raw material till there is a desired circulation load, and continuing the process so that as much end product material is removed from the process as raw material is added to the process, and wherein said mixing step includes the step of feeding the material alternately into side by side double-valve feeders and balancing tanks, where a feed pressure in each double-valve feeder is higher than a regular feed pressure in an associated balancing tank, and synchronizing the double-valve feeders so that an after-pressure left in one double valve feeder after release of the material into the associated balancing tank is utilized as initial pressure in the other double-valve feeder after receipt of material therein.

2. A method according to claim 1 characterized in that a pulp density of the solids collected in the intermediate tank is raised by a pressing screw conveyor before returning the solids to the counterjet pulverizer.

3. A method according to claim 1, wherein conveying of the gas-solids suspension is broken or choked for a while, when the lower valve of each double-valve feeder is opened.

4. A method according to claim 3, wherein pulverizing is carried out at least in two counterjet pulverizers, whereby there is in one of said counterjet pulverizers conventional acceleration nozzles and in the other of said counterjet pulverizers acceleration nozzles furnished with gas outlet channels for effective pulverizing of high dispersed material.

5. A method according to claim 1, further including the steps of: removing the end product from the intermediate tank, conveying the end product to a separate mechanical classifier outside the pulverizing cycle, separating of greatest sized particles from the end product, and returning the greatest sized particle to the intermediate tank for an additional pulverizing cycle.

6. A method according to claim 5, wherein the greatest sized particles separated by classifier are returned to intermediate tank using a pneumatical transfer from the intermediate tank of the double-valve feeder after initial pressurizing by the initial pressure.

7. A method according to claim 1, further including the step of programming, in order to ensure a uniformity of the end product quality, a control unit with limit values of selected most important parameters of the pulverizing process, the parameters being selected from the group comprising a) a quantity of raw material, b) a volume, a pressure and a temperature, of a working gas, c) a quantity of energy used for working gas pressurization, and d) a quantity of the circulation load.

8. A method according to claim 1, wherein pulverizing conditions are regulated so that there is in the end product a portion of particles in a granular class of 0.2-5 μm.

9. A method according to claim 8, wherein the material to be pulverized is circulated between 2-10 times in order to achieve a set granular class.

10. A method according to claim 9, wherein the material to be pulverized is circulated between 4-7 times.

11. A method according to claim 1, further including the step of pre-pulverizing the raw material with a mechanical pulverizer.

* * * * *